United States Patent [19]

Stone et al.

[11] 4,276,127

[45] Jun. 30, 1981

[54] CHANNEL PLATE ELECTRON MULTIPLIERS

[75] Inventors: Henry D. Stone, Ashtead; Alan G. Knapp, Crawley; John R. Mansell, East Grinstead; Colin D. Overall, Reigate; Derek Washington, Wallington, all of England

[73] Assignee: U.S. Philips Corporation, New York, N.Y.

[21] Appl. No.: 47,392

[22] Filed: Jun. 11, 1979

[30] Foreign Application Priority Data

Jun. 14, 1978 [GB] United Kingdom ..... 26878/78

[51] Int. Cl.[3] ..... C25D 7/06; C25D 11/10

[52] U.S. Cl. ..... 204/24; 204/58

[58] Field of Search ..... 204/24, 26, 58, 37 R

[56] References Cited

U.S. PATENT DOCUMENTS

| | | | |
|---|---|---|---|
| 3,494,840 | 2/1970 | Dedrick | 204/58 |
| 3,647,645 | 3/1972 | Carrillo | 204/24 |

FOREIGN PATENT DOCUMENTS 1325309 8/1973 United Kingdom .

*Primary Examiner*—T. M. Tufariello

*Attorney, Agent, or Firm*—Thomas A. Briody; Robert T. Mayer; Jack E. Haken

[57] ABSTRACT

Channel plate image intensifiers, for use as raster intensifiers in cathode ray tubes for example, comprise a stack of alternately arranged perforate laminar dynodes M and perforate laminar separators D aligned to form electron multiplier channels P. Each of the separators comprise a perforate aluminium plate having an anodized layer some 15 microns thick on the plate surface. Such separators can be manufactured to have the desired electrical characteristics and uniform thickness over their entire area so that the dynodes M are parallel to each other and provide a uniform gain over their entire area.

The invention also relates to a method of anodizing perforate and imperforate aluminium foils.

2 Claims, 8 Drawing Figures

CHANNEL PLATE ELECTRON MULTIPLIERS

Figure 1:
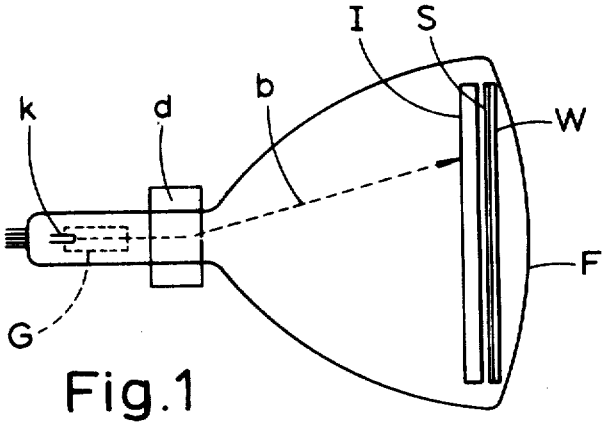

The invention relates to channel plate electron multipliers comprising a stack of alternate perforate laminar dynodes and perforate laminar separators, the perforations of said dynodes and separators being aligned to form electron multiplier channels. The invention also relates to cathode ray tubes incorporating such channel plate electron multipliers and to a method of anodizing aluminum plates suitable for use as a separator in a channel plate electron multiplier.

British Patent Specifications Nos. 1,401,969, 1,402,549 and 1,457,213 describe materials for such separators including glass, polyimide and aluminum oxide. In the latter case the oxide is formed by anodising aluminium or aluminium alloy dynodes. There may be advantages, however, in using dynodes made of mild steel since the technology for making perforated mild steel shadow masks for colour television tubes is well established. Such shadow masks are in fact of much the same thickness and have much the same perforation size and spacing as is required for the dynodes of a channel plate electron multiplier for use as a scanning beam intensifier in a television picture tube. Presently, however, there are no very practical methods of laying down an aluminium oxide coating on a steel surface to separate the dynodes by an adequate distance.

The invention provides a channel plate electron multiplier comprising a stack of alternately arranged perforate laminar dynode plates and perforate laminar separator sheets being aligned to form electron multiplier channels, wherein each separator comprises a perforate aluminium plate having an anodized layer on the plate surface. The perforations in the separator may be substantially larger than those in the dynodes, having the effect of (a) reducing the total plate area in contact with a dynode and hence increasing the electrical leakage resistance, (b) providing a mechanical tolerance in hole-to-hole registration to avoid interference by the separator with electron paths in any multiplier channel, and (c) reduce the possibility of any electrons which drop-out on passing from one dynode to the next striking the walls and causing a negative charge to be built-up on the insulating walls. It is this charge which opposes the passage of further electrons through the channels.

The anodised layer thickness is in the range 10 to 20 microns and is typically 15 microns. It may provide sufficient electrical isolation even if the walls of the perforations are not anodised. In this case, the perforations can be made by photo-etching after the separator surfaces have been anodised.

Using separators of anodised aluminium fulfils a number of desirable characteristics for separators namely achieving the desired quality of insulation, uniformity in separation across the entire area of the dynode assembly and repeatability and uniformity in production of the separators. Accordingly an improved uniformity in gain of the channel plate multiplier should be obtained.

The invention also provides a method of anodizing aluminium plates suitable for use as a separator in a channel plate electron multiplier, which method includes placing an aluminium plate between and substantially equidistant from a pair of planar cathodes in an anodising bath, applying a potential difference between the plate and the cathodes so as to maintain a constant current density at the plate whilst maintaining the plate at a substantially uniform temperature over its entire area and oscillating the plate in its own plane to remove any adhering gas bubbles.

The invention may also provide a display device including a cathode ray tube comprising an envelope in which there is provided an electron gun for producing an electron beam, a luminescent screen, a channel plate electron multiplier incorporating anodised aluminium separators, said channel plate being disposed adjacent to but spaced from the luminescent screen, and means for causing said electron beam to scan an input side of said channel plate electron multiplier.

Figure 2:
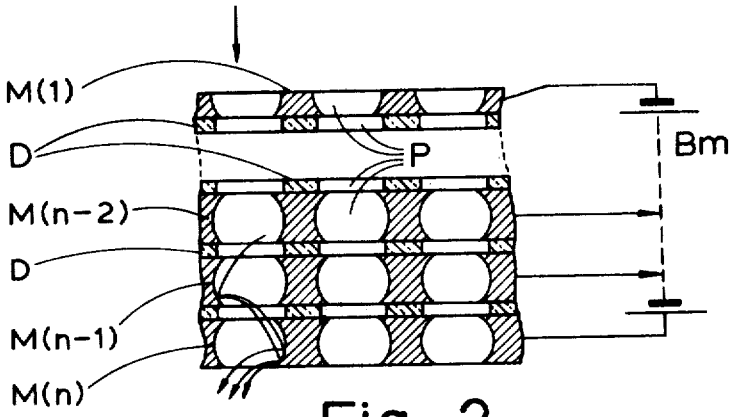
Figure 3:
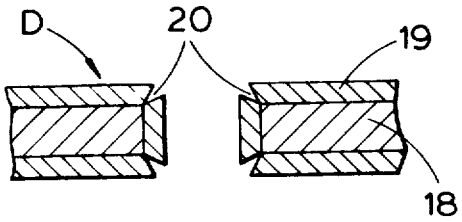
Figure 4:
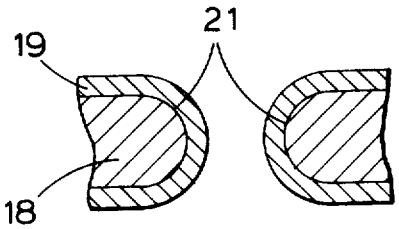
Figure 5:
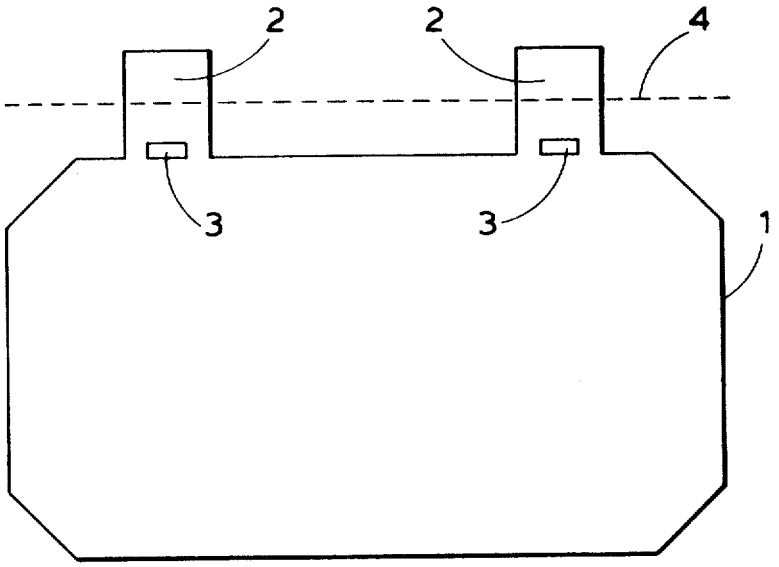
Figure 6:
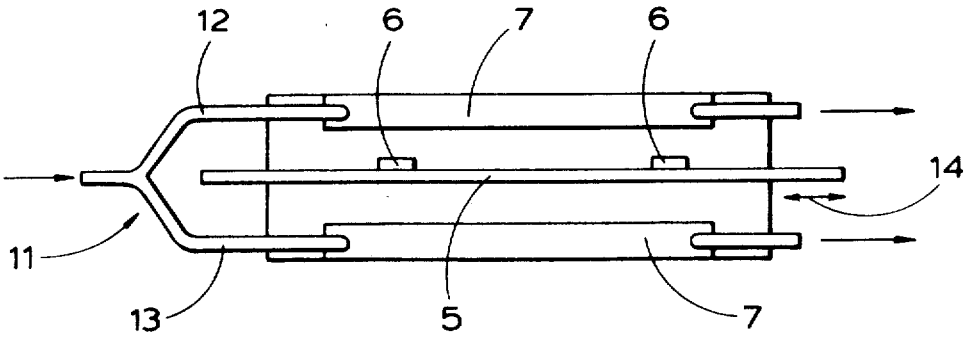
Figure 7:
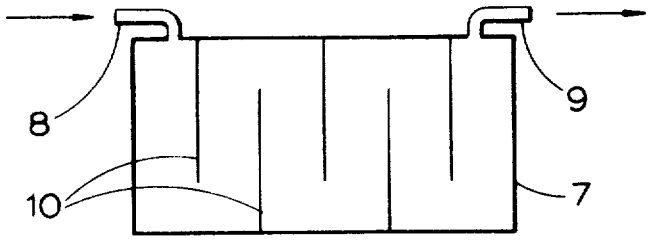
Figure 8:
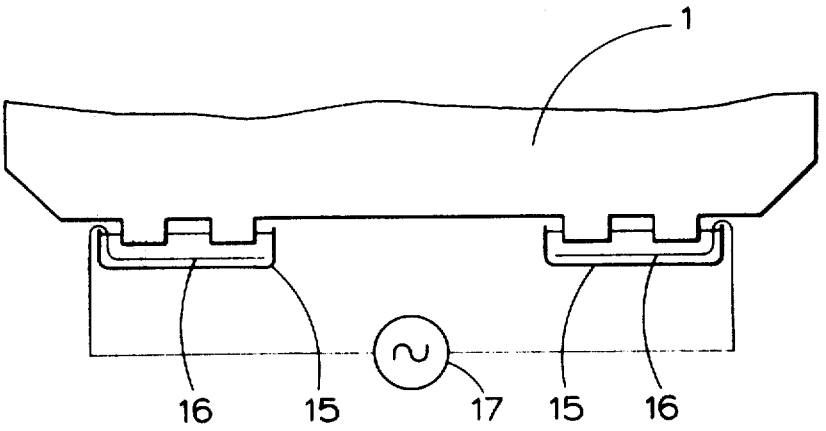

Embodiments of the invention will now be described, by way of example, with reference to the accompanying drawings in which:

FIG. 1 shows a cathode ray tube display device incorporating a channel plate electron multiplier, FIG. 2 shows a section of a channel plate electron multiplier having anodised aluminium separators, FIG. 3 shows a section of a separator perforation in which the anodised layer is not continuous around the perforation corners, FIG. 4 shows a section of a separator perforation in which the anodised layer is continuous around the perforation corners, FIG. 5 shows a separator prepared for anodising, FIG. 6 shows a plan view of an anodising bath, FIG. 7 shows an internal elevation of a water-cooled cathode, and FIG. 8 shows an arrangement for anodising the cut ends of the separator support tabs.

To illustrate an application of the present invention, FIG. 1 shows a cathode ray display tube comprising an electron gun G (including a cathode k) for generating a beam b which is deflected by means d so as to scan a channel plate I constructed in accordance with the invention. The plate I is followed by a luminescent screen S which may be laid on a flat glass window or support W as shown. Window W may be viewed through a clear, curved face-plate F forming part of the envelope of the tube. Alternatively, support W may be made of suitably toughened glass and may form the vacuum supporting face plate of the tube.

FIG. 2 shows an axial section of a small portion of a laminated channel plate electron multiplier suitable for use as the channel plate I in the cathode ray tube described with reference to FIG. 1. The first dynode M(1) and the last three dynodes, M(n-2), M(n-1) and M(n), are shown of a channel plate having n stages. The dynodes M are separated from one another by insulating separators D. The aligned perforations P in the dynodes M and the separators D form electron multiplier channels. The separator perforations are substantially larger than the dynode perforations. In operation all the dynodes M are fed, as shown, with increasing positive potentials, from M(1) to M(n), by a tapped D.C. supply source shown schematically at Bm.

It has been previously suggested to use aluminium oxide as a material for the separators D. The oxide may be formed by anodising aluminium or aluminium alloy dynodes. However, there are at present a number of advantages in using dynodes made of mild steel, and there are no practical methods for producing an aluminium oxide coating on the steel surface of sufficient thickness to separate the dynodes by an adequate distance. The present invention overcomes this problem by using a separate sheet of perforated anodised aluminium as the separator element between each pair of adjacent dynodes.

Dynodes as used in laminated channel plates are described in British Patent Specification No. 1,434,053 and more specifically are as shown in FIG. 4 of that Patent. Typical dimensions are a channel pitch of about 0.8 mm, a dynode thickness of 0.3 mm and a dynode separation of about 0.1 mm. A separator can be made from a sheet of aluminium about 0.1 mm thick, using photochemical milling techniques to produce an array of perforations which are so positioned as to align with those in the dynode (and are preferably larger than those in the dynode). The perforated sheet is then anodised, by a method to be described hereafter, to form a surface coating of aluminium oxide which may typically be of the order of 15 μm thick. Alternatively the aluminium sheet can be anodised first and then the array of perforations made by photo-chemical milling. In this case the inside of each perforation will have an area of aluminium exposed at the surface. If desired, this aluminium may be covered by an oxide layer using a second anodising stage.

Channel plates can be made by assembling dynodes and separators alternately as shown in FIG. 2. For channel plates of small area the assembly may be clamped together. Where large areas are of interest a more rigid structure can be made by bonding the dynodes to the separators. Possible bonding agents include glass enamel, potassium silicate solution, polyimide adhesive and Silvac (Trade Mark) which is a vacuum-compatible adhesive.

Channel plates with insulating separators made of anodised aluminium exhibit good insulation and voltage breakdown performance. For example, plates having an area of 150 mm×200 mm give resistances greater than $10^{11}\Omega$ and voltage breakdown limits of >1000 V between adjacent dynodes. This performance is superior to that obtained using screen printed glass or polyimide separators and may be improved further by subsequently using other anodising solutions such as borax/-boric axid to achieve an even higher resistance and higher voltage breakdown.

The use of anodised aluminium is at present primarily aimed at insulating separators. However, resistive separators as described in Patent Specification No. 1,401,969 can be produced by depositing an electrically resistive coating on the anodised faces inside the perforations.

An example of a method for making an insulating anodized aluminium separator will now be given. In this example, the holes are etched first and then the surfaces of the separator and the inside walls of the holes are anodised simultaneously.

The raw material from which the anodized aluminium separator is made is rolled aluminium sheet 110 microns thick and 99.70% pure. As shown in FIG. 5, the separator blank is cut to rectangular shape, 23 cm by 16 cm, one long edge being left with two tabs 2 as shown in FIG. 5. Each tab has a rectangular aperture 3, the lower edge of which is in line with the top edge of the blank. The tabs serve to support the separator mechanically and to provide electrical connection during the etching and anodising processes. When the separator has been anodised, tabs 2 are cropped off along a line passing through the centers of apertures 3. The exposed metal stubs of the tabs are then anodised over by a method, to be described later, which ensures that the anodised layer is complete over the entire separator surface.

First, the separator is annealed by being sandwiched between inert flat plates for 20 to 30 minutes at 200° C. The matrix of holes required for the dynodes are then etched through the aluminium sheet using standard photo-resist techniques and a mask derived from the artwork used to produce the dynodes. The hole etching will not be described further as it is not relevant to the subsequent anodising process. Typically, the holes are 600 microns in diameter and are arranged in close packed array, the centres of adjacent holes being 773 microns apart.

In all the cleaning, etching and anodizing processes to be described, the separator is always supported with the surface of the bath at the level 4 shown half-way up the tabs 3 and with a clearance of the order of 2 cm between the lower edge of the separator and the bottom of the bath. It has been found that particularly fast etching and anodizing action occurs in the top 2 to 3 mm of the liquid. Accordingly it is essential to mask this area on each tab to prevent the tab being severed from the rest of the separator. A suitable masking agent is potassium silicate, brushed on as a 0.1 molar solution and dried in an air stream at 150° to 200° C. to produce a glassy surface. Three such applications are needed on each side of each tab to build up an adequately resistant layer.

All the following processes are conducted in a flow cabinet having a continuous upward flow of filtered air. This is desirable to prevent contamination of the separator surface with airborne particles which may become included in the anodising layer, rendering the separator useless as en electrical insulator.

It is essential to remove all traces of organic contamination from the separator, such as traces of the photoresist used when the holes were made, finger marks, etc. The separator is therefore immersed in fuming nitric acid for 5 minutes at room temperature and then washed in deionized water which has been filtered to 0.22 micron particle size.

It is then necessary to remove the standing aluminium oxide layer. To this end, the separator is immersed in a 5% solution of Analar sodium hydroxide for a period not exceeding 30 seconds and which may only be a few seconds. Upon immersion, hydrogen gas is evolved as the oxide and some aluminium is removed. As the oxide clears, the rate of evolution of hydrogen increases and at this point the separator is removed from the sodium hydroxide and washed in filtered deionised water. While still wet, the separator is transferred to the anodizing bath which is a 5% weight/volume solution of oxalic acid with a chloride content of not more than 0.04 grams per litre filtered to 0.22 microns.

The anodizing bath is shown in plan view in FIG. 6. A horizontal support bar 5 is provided with two clips 6 spaced to correspond with the tabs 2. The clips 6 have sufficient flexibility at their point of mechanical and electrical connection with the bar 6, that the separator, when attached to the clips 6, hangs free of horizontal stress.

The separator 1 is supported in the anodizing bath equidistantly between two cathodes 7, typically at 7 cms from each cathode. It is essential if the separator 1 is to remain flat that the growth rates of the anodised layers on each side of the separator should be equal so that the layer thickness on the two sides will remain equal throughout the anodising process. As the anodised layer is formed, it expands relative to the aluminium, and any difference in layer thickness on either side of the separator will produce curling of the separator. Curling of the separator is avoided by maintaining a substantially uniform temperature throughout the bath.

With the current densities concerned the top of the bath will be appreciably hotter than the bottom due to convection. This temperature variation is counteracted by cooling the bath by circulating water through the cathodes so that cold water is admitted to the top of the cathode and removed from the bottom. FIG. 7 shows the internal structure of a cathode 7, having a water inlet 8, a water outlet 9 and baffles 10. In FIG. 6 a water manifold 11, connected to the two inlets 8, is fed with tap water at 10° to 12° C., the flow rates in the arms 12 and 13 being equalised by valve means not shown. The flow rate is adjusted to keep the temperature of the bath below 20° C. The cathode 7 may be of stainless steel, but aluminium is preferred for longer life and lower contamination of the bath. In operation the heat produced during the anodizing action results in the top 2 to 3 mm of the acid being hotter and hence more reactive, as noted above. The bottom of the bath remains cool while the middle depth surrounding the separator is kept stirred to some extent by the bubbles evolved during anodizing.

The anodised layer must extend equally over the walls of the holes through the separator as over the surfaces thereof. Some bubbles evolved during anodizing tend to adhere to the surface and to become lodged in the holes and must be continuously removed to maintain the rate of anodising equally on the surfaces and in the holes. To this end, the bar 5 is oscillated, by means not shown, in the direction 14 with an amplitude of 1 mm to 2 mm peak-to-peak. The frequency of the oscillation is in the range 10 to 30 Hz, frequencies around 22 Hz and 27 Hz being found particularly effective for the particular separator described herein.

A constant current power supply is used for the anodising, the current density on the separator surface, hole wall area included, being set at 1 amp. per square decimeter—the total bath current being 5 amps, this current being maintained until an anodised layer of 15 microns is formed which normally requires 40 to 45 minutes. Throughout the anodising process the composition of the bath is monitored by measuring it pH value which should be 1.0. As appropriate oxalic acid is added to maintain this pH value.

The tabs 2 are now cropped off in a guillotine along a line passing through the centres of the apertures 3. The exposed metal ends are now anodized over using the apparatus shown in FIG. 8. The separator is inverted and each pair of the cut ends of the tabs are immersed in a separate bath 15 of oxalic acid provided with an electrode 16 of carbon paper or stainless steel. An alternating voltage of some 60 volts at 50 Hz is applied between the two electrodes 16 by the generator 17, which may be a variac transformer fed from the mains supply. The anodizing circuit is completed through the metal of the separator, anodizing taking place at each pair of cut ends on alternate half cycles of the current flow. The current is applied for about 45 minutes to build up a 10 micron thick layer of anodizing on the cut ends.

The separator is then removed from the bath, washed in filtered deionised water, hung vertically and washed down with analar quality isopropanol (propan - 2-01), filtered to 0.22 micron particle size, to remove the water.

The oxide layer formed on the separator by the above-described steps is of a porous nature insofar that the oxide layer consists of a quasi-regular array of pores, each of 100 to 200 Å units wide and extend through almost the entire depth of the oxide layer. These pores contain traces of water, propanol and oxalic acid, all of which must be removed if the separator is to have the required electrical characteristics and contamination of the cathode ray tube is to be avoided. An effective method of removing these residual chemicals is to bake the separator by sandwiching it between two of the nickel dynodes, placing the assembly on a flat glass plate in an oven and heating to 160° C. and then raising the temperature to 200° C. over 30 minutes. Any propanol is driven off and any oxalic acid decomposes into carbon dioxide and water vapour. This decomposition of axalic acid is unlike other well known anodising agents such as sulphuric, chromic and phosphoric acids which do not decompose into substances which are harmless to other internal components of the cathode ray tube. Before the temperature drops appreciably, a flat weight is placed on top of the assembly and the temperature raised to 450° C. for 30 minutes to anneal the aluminium. Cooling is allowed to take 4 hours. This baking step removes all the anodising material, renders the plate flat and since it is annealed, it is dimensionally stable.

The completed separator is then ready for assembly with dynodes and further such separators to form a channel plate electron multiplier.

The electrical insulation of a separator prepared by the above method may be impaired by a known phenomenon, termed stress cracking, occurring in the anodised layer at the sharp corners between the separator surfaces and the walls of the holes through the separator. FIG. 3 shows the cracks 20 in the oxide layer 19 which otherwise encloses the separator 18. Stress cracks are formed during the growth of the anodised layer because it is of lower density than the aluminium metal. The expanding anodised layer is insufficient to fill the extra volume required at sharp corners and the unfilled volume appears as a single crack. This crack increases in width with increasing anodised layer thickness.

Such cracks are undesirable in that there is a greater risk of insulation failure in the region of the cracks than there is through the continuous anodised layer. Crack occurrence can be eliminated for anodising thicknesses up to 15 microns by rounding the corners before anodising with an electro-chemical polishing process. Growth of the anodised film parallel to the surface is then sufficient to produce a continuous anodised layer without cracks.

A method of obtaining such rounded corners will now be described. The rounding of the corners is achieved by electropolishing using conventional baths and equipment, carried out immediately after the immersion in sodium hydroxide described above. However use of conventional operating conditions results only in enlargement of the holes and no rounding of the sharp hole edges.

It has now been found that if substantially lower current densities are used that good corner rounding is obtained with very little increase in hold diameter. Specifically, using either a sodium carbonate/sodium phosphate bath, more specifically a bath comprising 15% by weight sodium carbonate and 5% by weight trisodium phosphate at a temperature between 75° C. and 85° C., or a perchloric acid/acetic acid bath which are normally operated at 5 amps/dm$^2$ then only increase in hole diameter occurs and no rounding of the corners was obtained. However use of either of these baths around 0.1 amps/dm$^2$ produced good corner rounding with hardly a perceptible increase in hole diameter. After this step the separator is cleaned prior to anodising as described above.

Although the method of anodizing aluminium plates has been described with reference to making separators for a channel plate electron multipliers, it may be used for anodizing imperforate aluminium foils and perforate foils having a large open area, say 55% open area, which are particularly fragile in their non-anodized state.

We claim:

1. A method of making an anodized aluminum separator for use in a channel plate electron multiplier of the type comprising a stack of alternately arranged perforate laminar dynodes and perforate laminar separators, the perforations of said dynodes and separators being aligned to form electron multiplier channels, wherein each separator comprises a perforate, planar aluminum plate having an anodized layer on the plate surface, comprising the steps of:

placing a perforated aluminum plate between, and substantially equidistant from, a pair of planar cathodes in an oxalic acid anodizing bath;

applying a potential difference between the plate and cathodes and maintaining a constant current density of approximately 1 amp per square decimeter of separator area at the plate surface; while maintaining the plate at a substantially equal temperature over its entire area; and oscillating the plate, in its own plane, at a frequency in the range from 10 Hz to 30 Hz to remove any adhering gas bubbles therefrom; and subsequently baking the plate to remove oxalic acid from said perforations.

2. A method as claimed in claim 1 further comprising the step of rounding the intersection of the plate surface with internal walls of each perforation by electro-polishing at a current density of approximately 0.1 ampere per square decimeter prior to the steps of claim 1.

* * * * *